US005180885A

United States Patent [19]

Shah

[11] Patent Number: 5,180,885

[45] Date of Patent: Jan. 19, 1993

[54] ELECTROSTATIC CHARGE DISSIPATING ELECTRICAL WIRE ASSEMBLY AND PROCESS FOR USING SAME

[76] Inventor: Dinesh Shah, 2146 W. Knox Rd., Chandler, Ariz. 85224

[21] Appl. No.: 716,576

[22] Filed: Jun. 17, 1991

Related U.S. Application Data

[63] Continuation-in-part of Ser. No. 508,885, Apr. 12, 1990.

[51] Int. Cl.[5] ..... H01B 7/34

[52] U.S. Cl. ..... 174/36; 156/54; 174/68.1; 174/102 SC

[58] Field of Search ..... 174/36, 68.1, 72 A, 174/136, 102 SC; 138/128, 170, DIG. 1; 156/54, 203, 218; 220/680

[56] References Cited

U.S. PATENT DOCUMENTS

| | | | |
|---|---|---|---|
| 3,329,764 | 7/1967 | Tanges, Jr. . | |
| 3,684,821 | 8/1972 | Miyauchi et al. | 174/102 SC |
| 3,719,769 | 3/1973 | Miyauchi et al. | 174/120 SC |
| 3,770,556 | 11/1973 | Evans et al. | 428/77 |
| 3,787,255 | 1/1974 | Carini et al. | 174/120 R X |
| 3,876,462 | 4/1975 | Carini et al. | 174/120 SC X |
| 3,914,363 | 10/1975 | Bedard et al. | 174/120 SC X |
| 4,155,613 | 5/1979 | Brandeau | 174/36 X |
| 4,323,721 | 4/1982 | Kincaid | 174/36 |
| 4,327,246 | 4/1982 | Kincaid | 174/36 |
| 4,347,487 | 8/1982 | Martin | 174/36 X |
| 4,409,427 | 10/1983 | Plummer, III | 174/36 |
| 4,791,236 | 12/1988 | Klein et al. | 174/36 |
| 5,008,488 | 4/1991 | Nakagawa | 174/36 |
| 5,030,794 | 7/1991 | Schell et al. | 174/36 |
| 5,037,999 | 8/1991 | Van Deusen | 174/36 |
| 5,052,444 | 10/1991 | Messerly et al. | 174/47 X |

FOREIGN PATENT DOCUMENTS 942142 7/1960 United Kingdom .

*Primary Examiner*—Morris H. Nimmo

[57] ABSTRACT

An electrostatic charge dissipating protective jacket for bundles of wire made from a polyether-based polyurethane sheet encircling the bundle with the overlapping edges bonded together by an adhesive under pressure at room temperature and containing an electrostatic charge dissipating material, such as conductive carbon black.

8 Claims, 2 Drawing Sheets

ELECTROSTATIC CHARGE DISSIPATING ELECTRICAL WIRE ASSEMBLY AND PROCESS FOR USING SAME

RELATED APPLICATIONS

This application is a continuation-in-part of an application, Ser. No. 07/508,885, filed on Apr. 12, 1990.

FIELD OF THE INVENTION

The invention relates to assemblies of electrical wires which are bundled into an outer protective plastic jacket which mitigates physical damage to such wires and also is electrically conductive so that the jacket will dissipate an electrostatic electrical charge which may be carried in the assembly by constant movement, such as bending or flexing in use of the assembly.

Plastic protective jackets for wires are known for use in physically protecting wires, usually in the form of plastic tubes or flat sheets of plastic having metal or plastic toothed edges. Tubes having zippers being a well known example thereof, which may be wrapped around a bundle of wires to provide a protective sheathing. Other plastic sheets having beaded or shaped edges which fit together to lock the edges of the sheet into the form of a tube may also be used. Such interlocking edge tubes may be complicated or expensive to manufacture, however, and may require tools or machines to close the edges into a tube thus adding to the cost of their use.

There remains a need for a simple, effective, economical means to provide a protective jacket for wires and cables and also a need for a jacket which can dissipate static electric charge formed in the jacketed assembly of wires and cables as a result of flexing or other causes.

SUMMARY OF THE INVENTION

The invention provides an electrical wire assembly that has a protective jacket which is simple to apply and can be removed and easily replaced when worn or when the assembly needs to be moved or replaced and which will cause dissipation of any charge of static electricity which may form in the assembly on use thereof. The protective jacket comprises an elongated flat electrically conductive polymer sheet of dimensions suitable for enclosing and protecting a bundle or round or flat cables of selected length. The sheet is formed from a flexible polymer sheet, preferably of polyether based polyurethane polymer which contains a conductive material, particularly a conductive carbon black, having on one edge a strip of pressure-sensitive adhesive covered by release paper. The sheet is folded longitudinally into a tube surrounding a bundle of cables, the release paper removed from the adhesive strip, and the sheet overlapped around the cable bundle such that it adheres to itself to close the sheet into a tube. Pressure is applied by, for instance, a roller to seal the adhesive seam. A strip of the same conductive polymer material as used to form the sheet or a second conductive polymer material, which is coated with the same or a second pressure sensitive adhesive, is then applied to the sealed edge of the sheet which forms a tube around the bundle of cable after cleaning the surfaces of the tube to be bonded to the strip. The strip overlaying the sealed joint of the tube has pressure applied, such as by a roller, to seal the strip in place over the joint of the tube. The conductive polymer strip may be supplied with a release paper covering the pressure sensitive adhesive layer surface for convenience in handling until just before bonding occurs. A polyether based polyurethane polymer is preferred for the jacket and should contain a conductive carbon, such as carbon black, in the amount of about 0.5 to about 5.0%, with about 1.0 to about 1.5% being the preferable range. In this application the term "wire" is intended to include electrical cables, such as coaxial cables, for example.

DETAILED DESCRIPTION OF THE INVENTION

Figure 1:
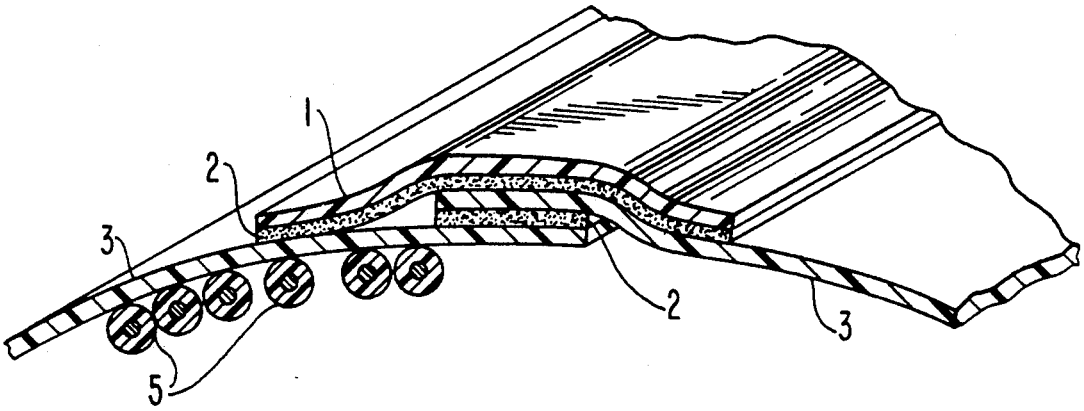
FIG. 1 is a cross-sectional view of a section of a jacket used in the invention in place around a bundle of wires.

With reference to the figures, a detailed description of the invention follows. FIG. 1 shows a section of conductive polymer sheet 3 which folds into a cylindrical tubular protective electrostatic charge dissipating jacket around wires or cables 5 (shown representatively) to be assembled into a bundle. A strip of adhesive 2 lies between the two edges of sheet 3 and between the joint and an overlying strip of electrostatic charge dissipating polymer sheet 1. Adhesive 2 is in this case a pressure-sensitive acrylic adhesive which has very high adhesion to polymer surfaces if the surfaces are first cleaned with an alcohol, such as isopropyl alcohol, or hydrocarbon solvent before the surfaces are adhered to each other by means of adhesive 2. Other adhesives may be used where they have high shear strength and peel strength equivalent to the preferred acrylic adhesive. The bond strength of the adhered surfaces depends on the amount of adhesive-to-surface contact developed, so means to increase the amount of contact are utilized, such as pressure rolling all adhesive joints with a roller, with or without some application of heat, such as about 70° F. to about 100° F., and allowing a few hours setting time after joining the surfaces for complete curing and bond strength build-up in the adhesive joint. Ultimate bond strength can be developed by exposing the joint to about 150° F. temperatures for about an hour. About 90% of the ultimate bond shear strength can be developed by aging 24 hours at ambient temperatures following rolling the joint under hand pressure.

Figure 2:
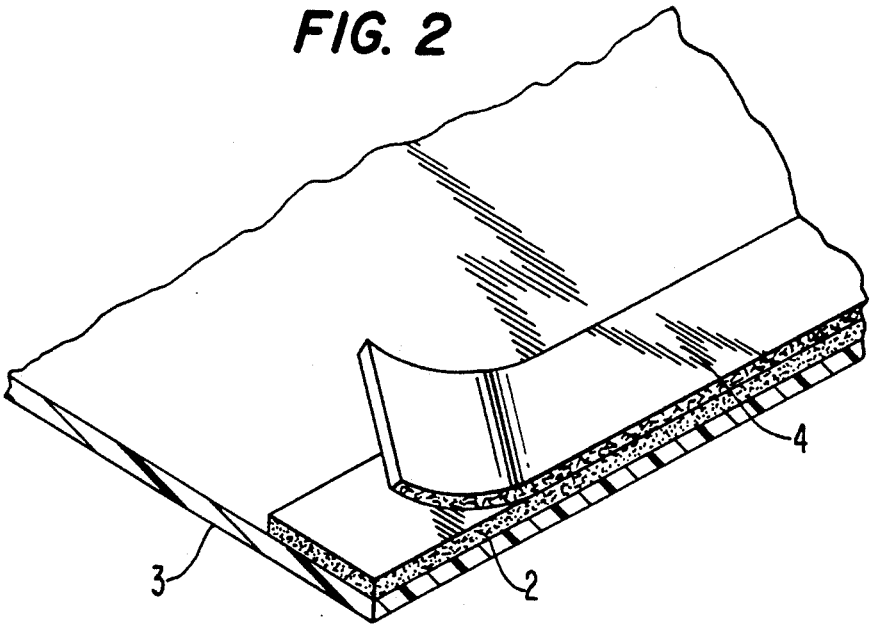
FIG. 2 is a fragmentary cross-sectional view of a segment of the conductive polymer having a layer of adhesive along one edge and a partially peeled-back release paper covering the adhesive.

FIG. 2 displays a cross-sectional view of a segment of the sheet of conductive polymer 3 used in the invention with a layer of pressure-sensitive adhesive 2 along the edge of sheet 3 to be joined with an opposite edge of sheet 3 to form a tube. Release paper 4 covers the adhesive strip 2 until it is peeled off to expose adhesive 2 for bonding to strip 3. Polymer sheet 3 preferably comprises a polyether-based thermoplastic polyurethane material which contains fillers, such as conductive carbon black. Sheet 3 preferably has a minimum elongation or stretchability, but is quite flexible and can be rolled and sealed into a small tube. Sheet 3 most often is used at about 5 to about 20 mils thickness with about a 5 mil thick layer of pressure-sensitive acrylic adhesive on it to bond the sheet into a close-fitting tube around a bundle of cables to be protected. Typical shear-strength for a sheet bonded as above is about 13 to about 15 pounds per inch in an Instron standard tensile tester at 2 inches per minute elongation rate. Standard tubes with zippers tested under the same conditions gave about 8 to about 11 pounds per square inch shear strength. Also, the bonded sheet of the invention did not shatter after 4 hours at −40° C. in an aging test. Most known tubes with zippers will not pass such a low temperature test.

Figure 3:
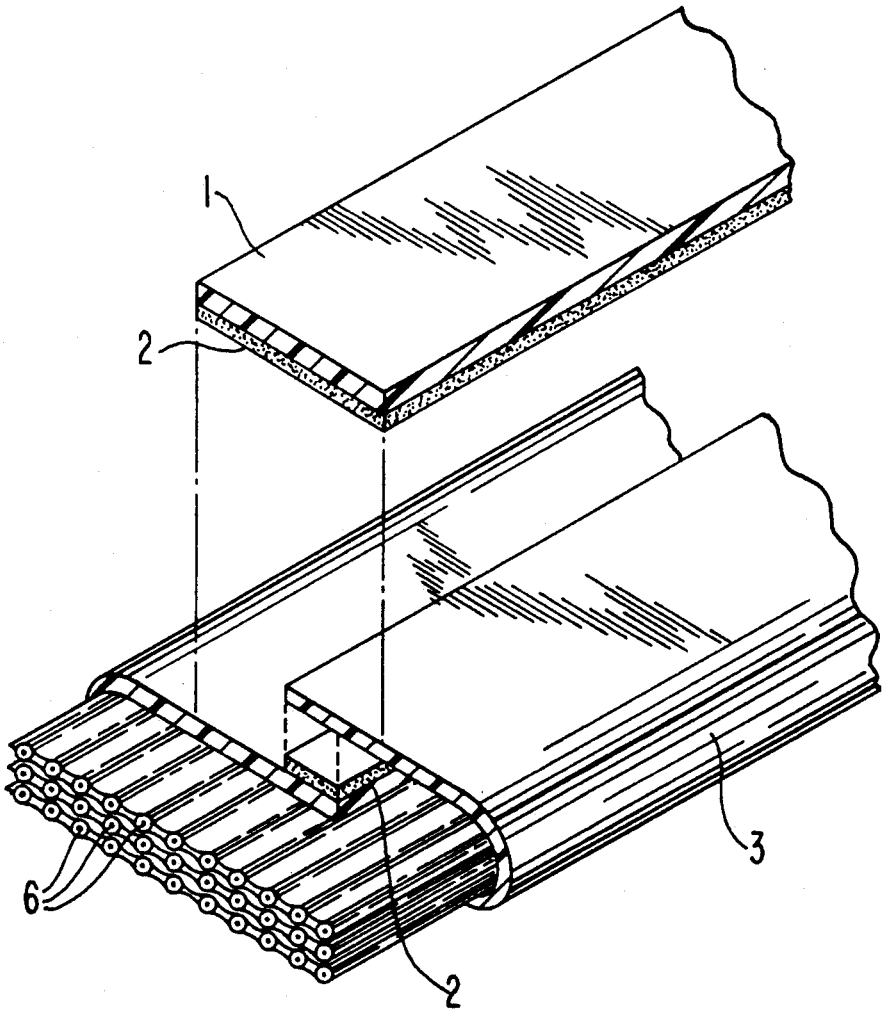
FIG. 3 is an exploded cross-sectional view of three flat cables surrounded by the conductive jacket with the adhesive edges of the polymer sheet below the other edge of the sheet to be sealed to it and the adhesive coated conductive polymer strip to be placed over the joined edges of the polymer sheet.

FIG. 3 depicts an exploded view of an electrostatic charge dissipating jacket 3 of the invention surrounding a bundle of three flat electrical signal cables 6, with sheet 3 surrounding the bundle of cables 6 with the edges of the sheet lined up for adherence to each other by adhesive strip 2. A flat strip overlies the joint, ready to be pressed down onto the above joint following the original bonding and pressure rolling with pressure rolling applied to seal this strip onto the joint.

Samples of assemblies of the invention in which the polyether based polyurethane contained conductive carbon were tested for their ability to dissipate electrostatic charge with results shown below.

| Sample Number | Time Required to Induce an Electrostatic Charge in Seconds | Time Required to Completely Dissipate the Electrostatic Charge in Seconds |
|---|---|---|
| 1 | 2.52 | 2.02 |
| 2 | 2.38 | 2.00 |
| 3 | 2.30 | 2.00 |
| 4 | 2.34 | 1.96 |
| 5 | 2.61 | 2.14 |
| Average | 2.43 | 2.03 |

The tests were performed in accordance with Method 4046, dated Jan. 15, 1969, Appendices B and C (Fed. Test Method Std. No. 101B).

The protective jacket of the invention is an economical replacement for toothed or shaped edge tubes, is usful at low temperatures, such as about −40° C., and has in addition the property of dissipating any electrostatic charge which may form on the jacketed assembly or bundle of wires and/or cables when they are flexed in use or otherwise acquire an electrostatic charge.

The jacket of the invention is easy to install on flat or round wire and cable bundles without special tools or jigs, may be also made flame retardant by use of appropriate fillers, may be colored for identification, and is very tough and abrasion-resistant in harsh environments.

I claim:

1. An assembly of electrical wires having a removable flexible protective jacket wrapped around said assembly of wires, said jacket comprising a sheet of polyether based polyurethane containing a conductive filler material which dissipates an electrostatic charge.

2. An assembly of claim 1 wherein the jacket comprises an elongated sheet folded around the assembly of wires to form an enclosing tube in which the longitudinal edges of the sheet overlap, in which the overlapping edges rae joined by an adhesive, and in which a separate band of a polymeric material is positioned and adhered longitudinally along the seam formed by the overlapping edges of said elongated sheet.

3. An assembly of claims 1 or 2 wherein said conductive filler material comprises a conductive carbon material.

4. An assembly of claim 3 wherein said conductive filler material comprises about 0.5 to about 5.0 weight % of said jacket material.

5. An assembly of claim 3 wherein said conductive filler material comprises about 1.0 to about 1.5 weight % of said jacket material.

6. An assembly of claim 3 wherein said conductive carbon material comprises carbon black.

7. An assembly of claim 2 wherein said separate band of polymeric material comprises polyether based polyurethane containing a filler material which dissipates an electrostatic charge.

8. A process of dissipating an electrostatic charge by subjecting an electrical wire assembly, comprising a sheet of polyether based polyurethane containing a filler material which dissipates an electrostatic charge, to an electrostatic charge, whereby the charge is dissipated by the filler material.

* * * * *